US011438684B2

(12) United States Patent
Lu

(10) Patent No.: US 11,438,684 B2
(45) Date of Patent: Sep. 6, 2022

(54) EARPHONE DEVICE, HEADPHONE DEVICE AND AUDIO PLAYING DEVICE

(71) Applicant: DEXIN CORPORATION, New Taipei (TW)

(72) Inventor: Ho-Lung Lu, New Taipei (TW)

(73) Assignee: DEXIN CORPORATION, New Taipei (TW)

( * ) Notice: Subject to any disclaimer, the term of this patent is extended or adjusted under 35 U.S.C. 154(b) by 0 days.

(21) Appl. No.: 17/213,108

(22) Filed: Mar. 25, 2021

(65) Prior Publication Data

US 2022/0078539 A1 Mar. 10, 2022

(30) Foreign Application Priority Data

Sep. 10, 2020 (TW) ..... 109131111

(51) Int. Cl.
*H04R 1/10* (2006.01)

(52) U.S. Cl.
CPC ..... *H04R 1/1016* (2013.01); *H04R 1/105* (2013.01); *H04R 1/1066* (2013.01)

(58) Field of Classification Search
CPC ..... H04R 1/1016; H04R 1/105; H04R 1/1066
See application file for complete search history.

(56) References Cited

U.S. PATENT DOCUMENTS 8,542,859 B2 * 9/2013 Alden ..... H04R 1/1066 381/376
8,755,555 B2 * 6/2014 Dougherty ..... H04R 1/1066 381/370
2014/0205129 A1 * 7/2014 Blair ..... H04R 1/1058 381/378

FOREIGN PATENT DOCUMENTS

GB 2562237 A * 11/2018 ..... H04R 1/1033
WO WO-2013062454 A1 * 5/2013 ..... H04R 1/1066

* cited by examiner

*Primary Examiner* — Angelica M McKinney
(74) *Attorney, Agent, or Firm* — Li & Cai Intellectual Property (USA) Office

(57) ABSTRACT

An earphone device, a headphone device, and an audio playing device are provided. The earphone device is configured to be used with a headset accessory. The earphone device includes a first earphone unit and a cable. The cable further includes a splitter, and the splitter is electrically connected to each of an earphone plug and the first earphone unit. The splitter has a jack. The first earphone unit has a through hole provided for insertion of the headset accessory, such that the headset accessory is detachably connected to the first earphone unit.

18 Claims, 11 Drawing Sheets

EARPHONE DEVICE, HEADPHONE DEVICE AND AUDIO PLAYING DEVICE

CROSS-REFERENCE TO RELATED PATENT APPLICATION

This application claims the benefit of priority to Taiwan Patent Application No. 109131111, filed on Sep. 10, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an audio listening device, and more particularly to an earphone device.

BACKGROUND OF THE DISCLOSURE

Conventionally, earphone devices can be worn in different ways. For example, headphones, in-ear earphones, ear-bud earphones, and ear-hook earphones are commonly seen. These different earphone devices each have their own pros and cons, and are favored by different user groups. However, an individual user usually has to purchase said different earphone devices separately to meet different needs, which may result in increased costs and inconvenience for being carried around.

SUMMARY OF THE DISCLOSURE

In response to the above-referenced technical inadequacies, the present disclosure provides an earphone device, a headphone device, and an audio playing device, which are scalable and can be externally connected to an earphone unit by choice. Accordingly, the earphone device can satisfy different wearing requirements.

In one aspect, the present disclosure provides an earphone device, which is configured to be used with a headset accessory. The earphone device includes a first earphone unit and a cable. The cable further includes a splitter, and the splitter is electrically connected to each of an earphone plug and the first earphone unit. The splitter has a jack. The first earphone unit has a through hole provided for insertion of the headset accessory, such that the headset accessory is detachably connected to the first earphone unit.

In another aspect, the present disclosure provides a headphone device, which includes a headset accessory, a first earphone unit, and a cable. The cable includes a splitter, and the splitter is electrically connected to each of an earphone plug and the first earphone unit. The splitter has a jack. The first earphone unit has a through hole provided for insertion of the headset accessory, such that the headset accessory is detachably connected to the first earphone unit.

In yet another aspect, the present disclosure provides an audio playing device configured to include an earphone port that has the earphone device plugged therein. The splitter in the earphone device includes a detection part. When the detection part detects that the jack has a second earphone unit plugged therein, the detection part outputs a first detection signal to a processing circuit of the audio playing device, and the processing circuit controls the audio playing device to play sound in a stereo mode according to the first detection signal. When the detection part does not detect that the jack has the second earphone unit plugged therein, the detection part outputs a second detection signal to the processing circuit of the audio playing device, and the processing circuit controls the audio playing device to play sound in a mono mode according to the second detection signal.

Therefore, in the earphone device, the headphone device, and the audio playing device provided by the present disclosure, through another earphone unit being optionally plugged into the splitter in the earphone device, the earphone device is capable of providing a stereo audio output or a mono audio output. Furthermore, the earphone device can be optionally used with the headset accessory to become the headphone device. In this way, the earphone device of the present disclosure provides listening and wearing flexibility when in use, thereby satisfying a variety of listening requirements.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
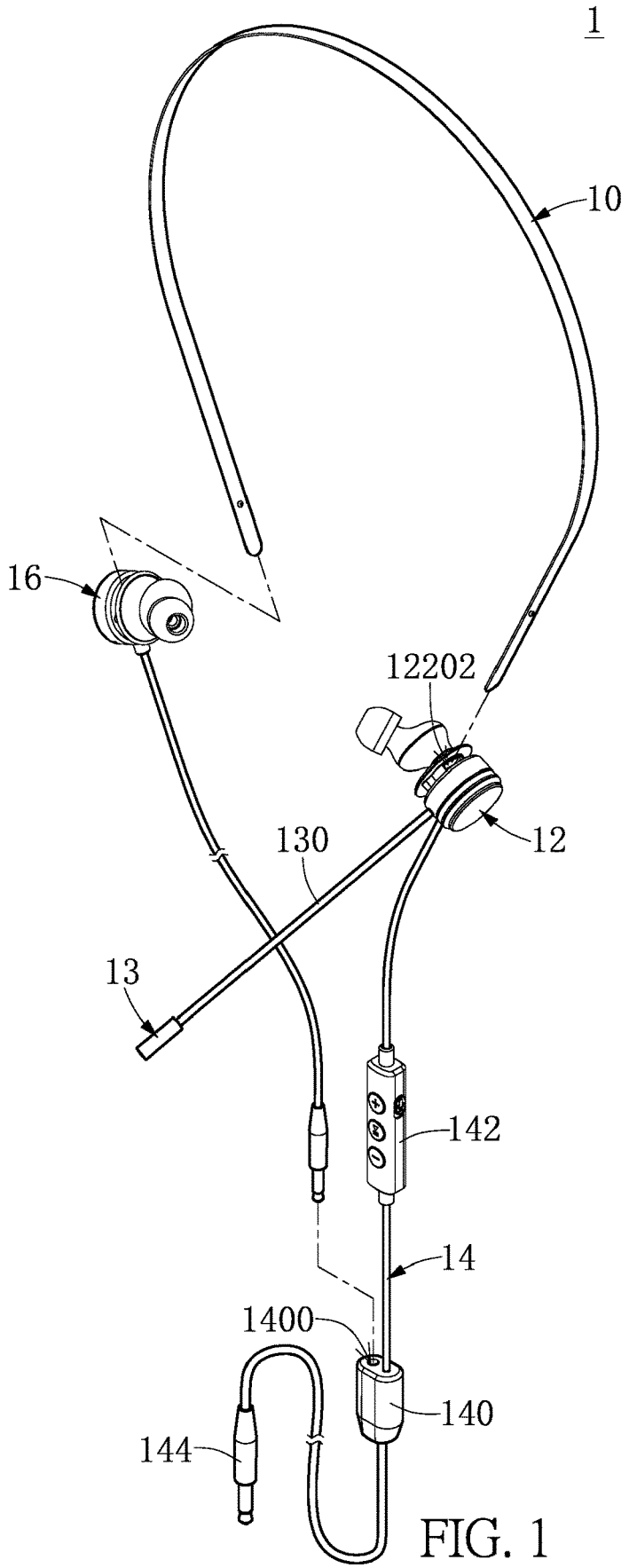
FIG. 1 is an exploded view of a headphone device according to one embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

An embodiment of the present disclosure provides an earphone device. The earphone device can be optionally used with a headset accessory to become a headphone device, or the earphone device can be used independently. During use, the earphone device can provide a mono audio output of one earphone unit or a stereo audio output of two earphone units according to requirements. When the earphone device is used for the stereo audio output from two earphones, depending on its scalability, the earphone device is externally connected to another earphone unit based on the hardware structure of the original earphone unit. Accordingly, the earphone device of the present disclosure can be used for different occasions. Through a design adapted for separable insertion, said earphone device can optionally have another earphone unit plugged thereto on the basis of the original earphone unit. Thus, different user habits for sound reception can be satisfied.

[Embodiment of Separate or Assembled Headphone Device]

Figure 2:
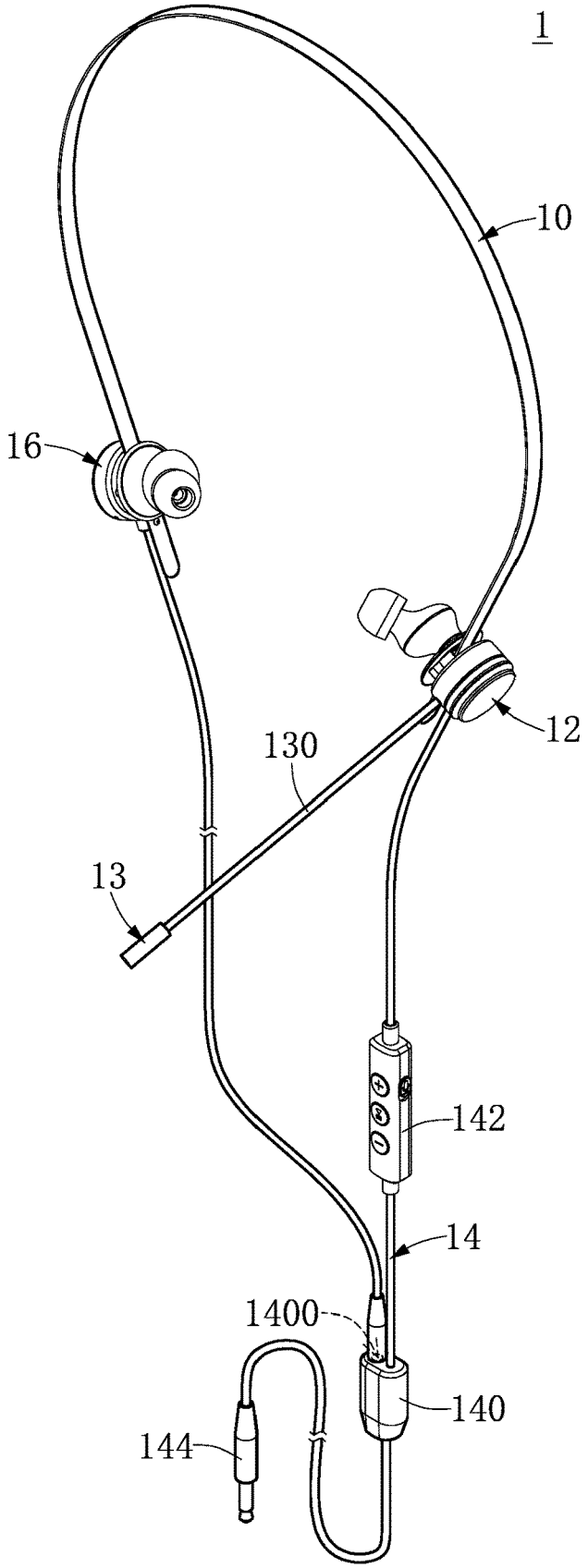
FIG. 2 is an assembled view of the headphone device according to one embodiment of the present disclosure.

Reference is made to FIG. 1 and FIG. 2, in which FIG. 1 is an exploded view of a headphone device according to an embodiment of the present disclosure, and FIG. 2 is an assembled view of the headphone device according to the embodiment of the present disclosure. A headphone device 1 of the present embodiment can include, for example but not limited to, a headset accessory 10 and an earphone device. The earphone device can be assembled to or separated from the headset accessory 10. In this instance, the earphone device can include, for example, a first earphone unit 12 and a cable 14. One end of the cable 14 is connected to the first earphone unit 12, and another end of the cable 14 is connected to an earphone plug 144.

It should be noted that a splitter 140 is further disposed at an appropriate location of the cable 14. One end of the splitter 140 is electrically connected to the earphone plug 144, and another end of the splitter 140 is electrically connected to the first earphone unit 12. In addition, the splitter 140 further has a jack 1400. The jack 1400, for example, is provided for having a second earphone unit 16 plugged therein. In the present embodiment, the splitter 140 is used to split and output an audio signal that is obtained by the earphone plug 144 to the first earphone unit 12 and the jack 1400.

For example, as shown in FIG. 1, when the jack 1400 does not have the second earphone unit 16 plugged therein, if the earphone plug 144 at this time receives one audio signal, the splitter 140 then outputs a single channel signal of the audio signal directly to the first earphone unit 12 for playing.

As shown in FIG. 2, when the jack 1400 has the second earphone unit 16 plugged therein, if the earphone plug 144 at this time receives one audio signal, the splitter 140 can not only output a single channel signal of the audio signal directly to the first earphone unit 12 for playing, but can also output another single channel signal of the audio signal through the jack 1400 to the second earphone unit 16 for playing.

The earphone device described herein can be used independently by including only the single first earphone unit 12 and the cable 14. Depending on practical requirements, while the earphone device includes the first earphone unit 12 and the cable 14, the earphone device can also be used by having the second earphone unit 16 that is adapted for separable insertion plugged into the jack 1400.

In one embodiment, the first earphone unit 12 of the earphone device can further include a microphone 13, and the microphone 13 is connected to the first earphone unit 12 via a connecting rod 130. However, the present disclosure is not limited thereto. The microphone 13 can also be embedded in other parts of the earphone device. For example, the microphone 13 can be disposed in the cable 14 or the first earphone unit 12.

In one embodiment, the cable 14 of the earphone device can further include an adjustment part 142. For example, the adjustment part 142 can be used for controlling the earphone device that includes functional operations such as adjusting the volume of sounds played, playing or pausing sounds, or receiving cell phone calls, but the present disclosure is not limited thereto.

With respect to use of the headset accessory 10, in one embodiment, the headset accessory 10 is detachably connected to the earphone device. Specifically, the first earphone unit 12 and the second earphone unit 16 each have a through hole 12202, which are provided for insertion of two ends of the headset accessory 10.

As shown in FIG. 1, the headset accessory 10 is not inserted into the through hole 12202. At this time, the headset accessory 10 is separate from the earphone device. As shown in FIG. 2, the two ends of the headset accessory 10 are inserted into the through hole 12202 of the first earphone unit 12 and the through hole 12202 of the second earphone unit 16, respectively. By inserting into the through holes 12202, the headset accessory 10 is at this time connected to the earphone device as one piece. In addition, a plug of the second earphone unit 16 is also plugged into the jack 1400 of the splitter 140.

Therefore, through a configuration of the through holes 12202 in the earphone device, the headset accessory 10 can be detachably connected to each of the first earphone unit 12 and the second earphone unit 16. That is to say, the headphone device 1 as shown in FIG. 2 can be worn on a head of a user by using the headset accessory 10, and the first earphone unit 12 and the second earphone unit 16 can be directly inserted into ears of the user, thereby allowing the user to hear stereo sound through a headset.

[Embodiment of Inserted Headset Accessory and Earphone Device]

Figure 3A:
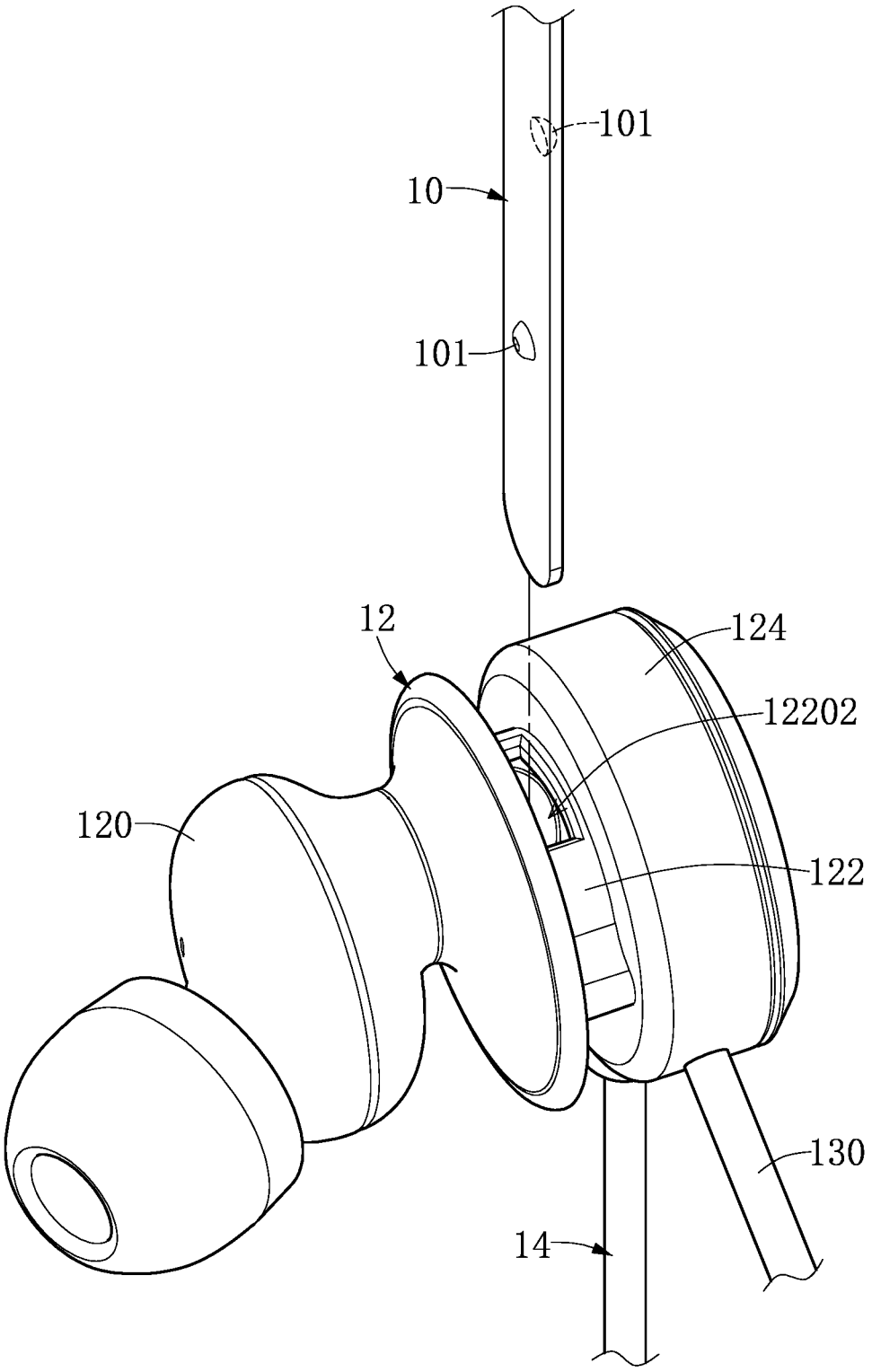
FIG. 3A is a schematic view showing a headset accessory not being inserted into a through hole of a first earphone unit according to one embodiment of the present disclosure.
Figure 3B:
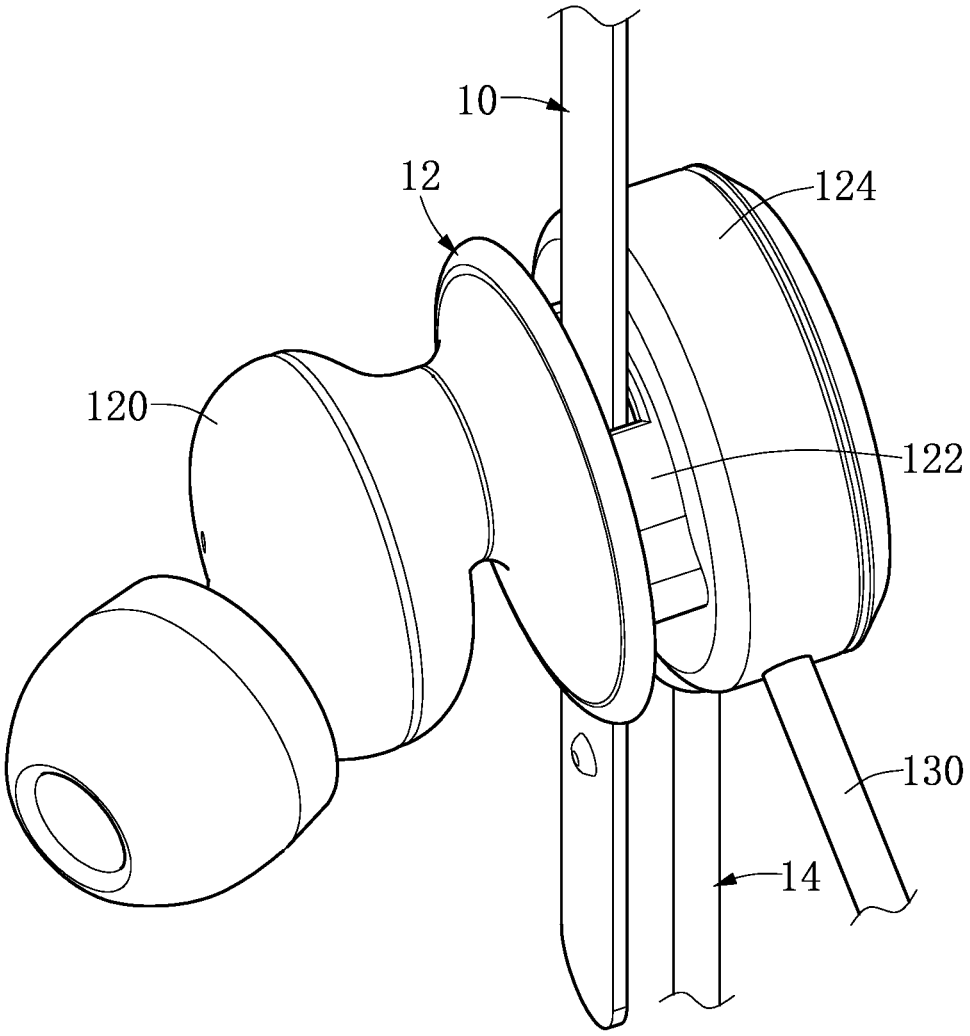
FIG. 3B is a schematic view showing the headset accessory being inserted into the through hole of the first earphone unit according to one embodiment of the present disclosure.
Figure 3C:
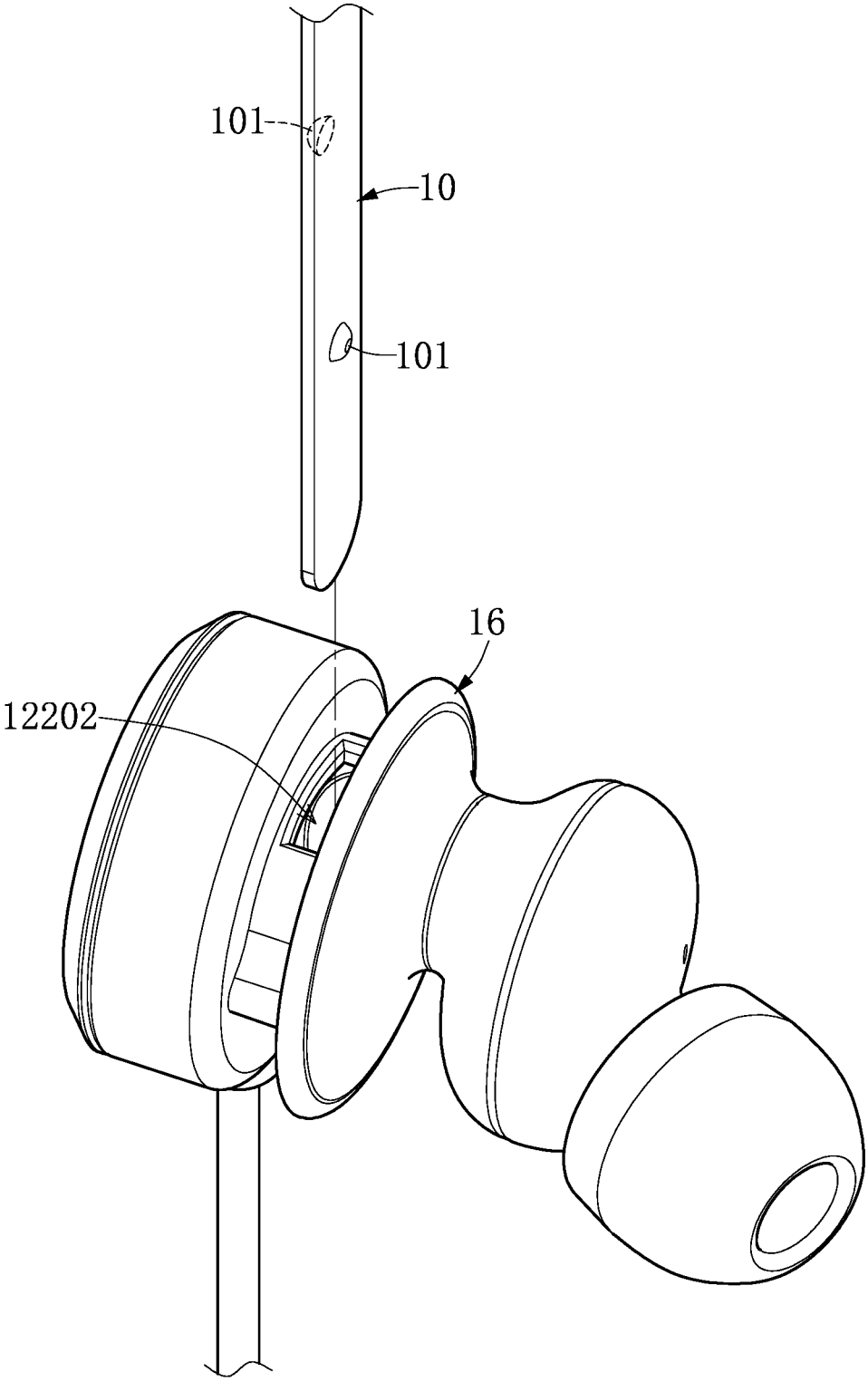
FIG. 3C is a schematic view showing the headset accessory not being inserted into a through hole of a second earphone unit according to one embodiment of the present disclosure.

Referring to FIG. 3A, FIG. 3B and FIG. 3C, FIG. 3A is a schematic view showing a headset accessory not being inserted into a through hole of a first earphone unit according to an embodiment of the present disclosure, FIG. 3B is a schematic view showing the headset accessory being inserted into the through hole of the first earphone unit according to the embodiment of the present disclosure, and FIG. 3C is a schematic view showing the headset accessory not being inserted into a through hole of a second earphone unit according to the embodiment of the present disclosure.

The first earphone unit 12 described herein includes, for example, a speaker 120, a connection part 122, and a base body 124. One end of the base body 124 is connected to the cable 14, another end of the base body 124 is connected to an end of the connection part 122, and another end of the connection part 122 is connected to the speaker 120. Specifically, the connection part 122 is disposed between the base body 124 and the speaker 120, and the connected part 122 has the through hole 12202 provided for insertion of the headset accessory 10. In another embodiment, the base body 124 can be disposed between the speaker 120 and the connection part 122, but the present disclosure is not limited thereto.

For example, to fit the shape of a head, the headset accessory 10 is configured to have a semi-circular shape. Appearance-wise, the headset accessory 10 can be, for example, a thin insert sheet, so as be smoothly inserted into the through hole 12202 of the first earphone unit 12. However, the present disclosure is not limited thereto. In addition, a midpoint of the headset accessory 10 (as shown in FIG. 1) when the headset accessory 10 is worn on the head is spaced apart from each of the two ends thereof (where the ears are located) by a same length. In other embodiments, the midpoint of the headset accessory 10 when the headset accessory 10 is worn on the head can be spaced apart from each of the two ends thereof by a different length. However, the present disclosure is not limited thereto.

As shown in FIG. 3A, the headset accessory 10 is not inserted into the through hole 12202. Through placing an end of the headset accessory 10 toward the through hole 12202, inserting the headset accessory 10 into the through hole 12202, and having the end of the headset accessory 10 exposed from another end of the first earphone unit 12 (as shown in FIG. 3B), the headset accessory 10 is successfully connected to the connection part 122 of the first earphone unit 12.

As shown in FIG. 3C, how the second earphone unit 16 is connected to the headset accessory 10 is identical to how the first earphone unit 12 is connected to the headset accessory 10, which will not be reiterated herein. In addition, when the headset accessory 10 is inserted into the through hole 12202, the headset accessory 10 can then be pulled out of the through hole 12202 by a separation method. In this way, the headset accessory 10 is configured to be detachably connected to the through hole 12202.

In one embodiment, one or a plurality of bumps 101 is further disposed on the headset accessory 10, and can be located at a same side or different sides of the headset accessory 10. The bumps 101 provide a positioning and a non-slip effect, such that the headset accessory 10 can be connected to the first earphone unit 12 at different locations of these bumps. The connection between the bumps 101 and the first earphone unit 12 will be described in further detail below.

[Embodiment of Connection Part]

Figure 4A:
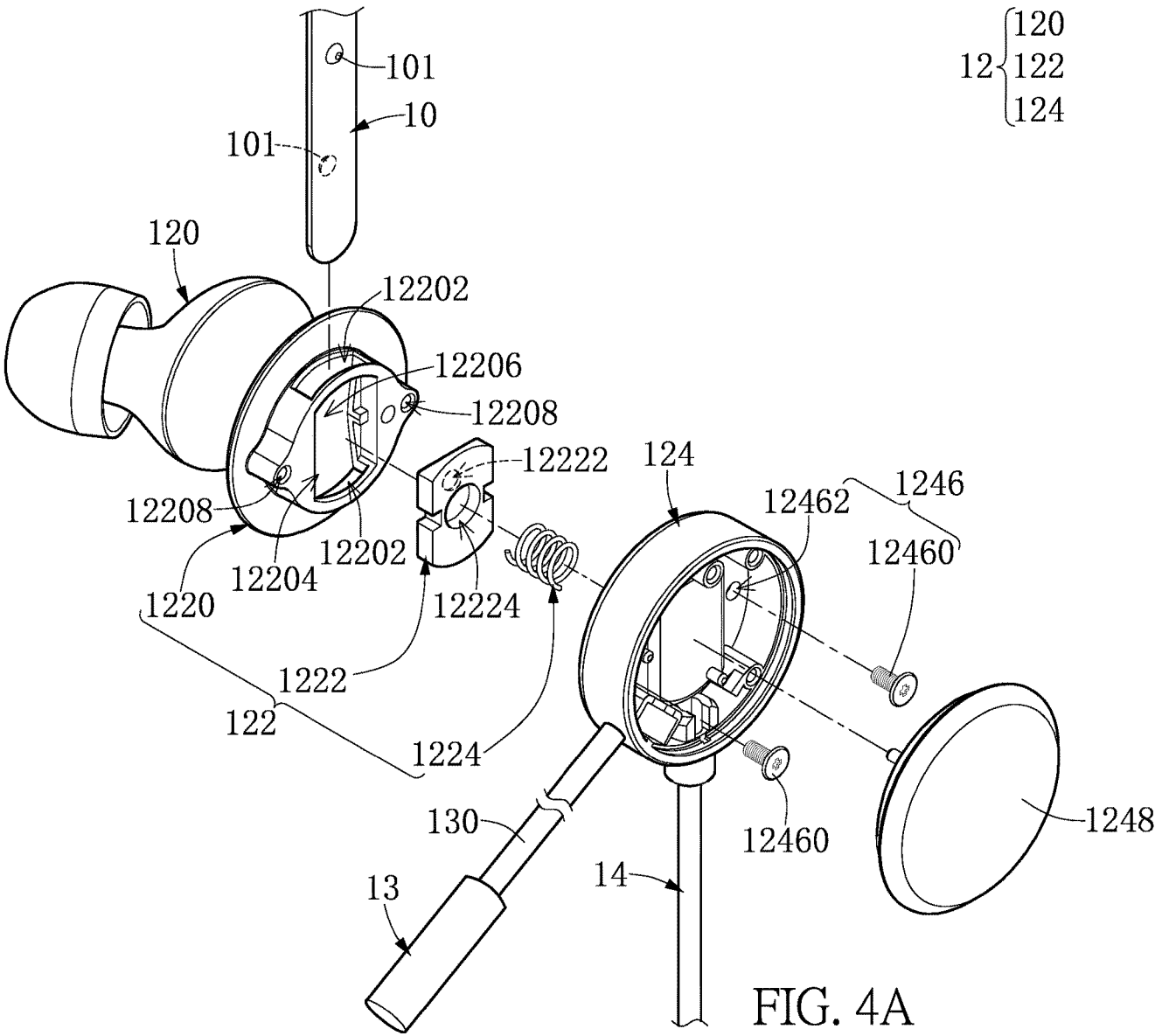
FIG. 4A is an exploded view of a connection part according to one embodiment of the present disclosure from one perspective.
Figure 4B:
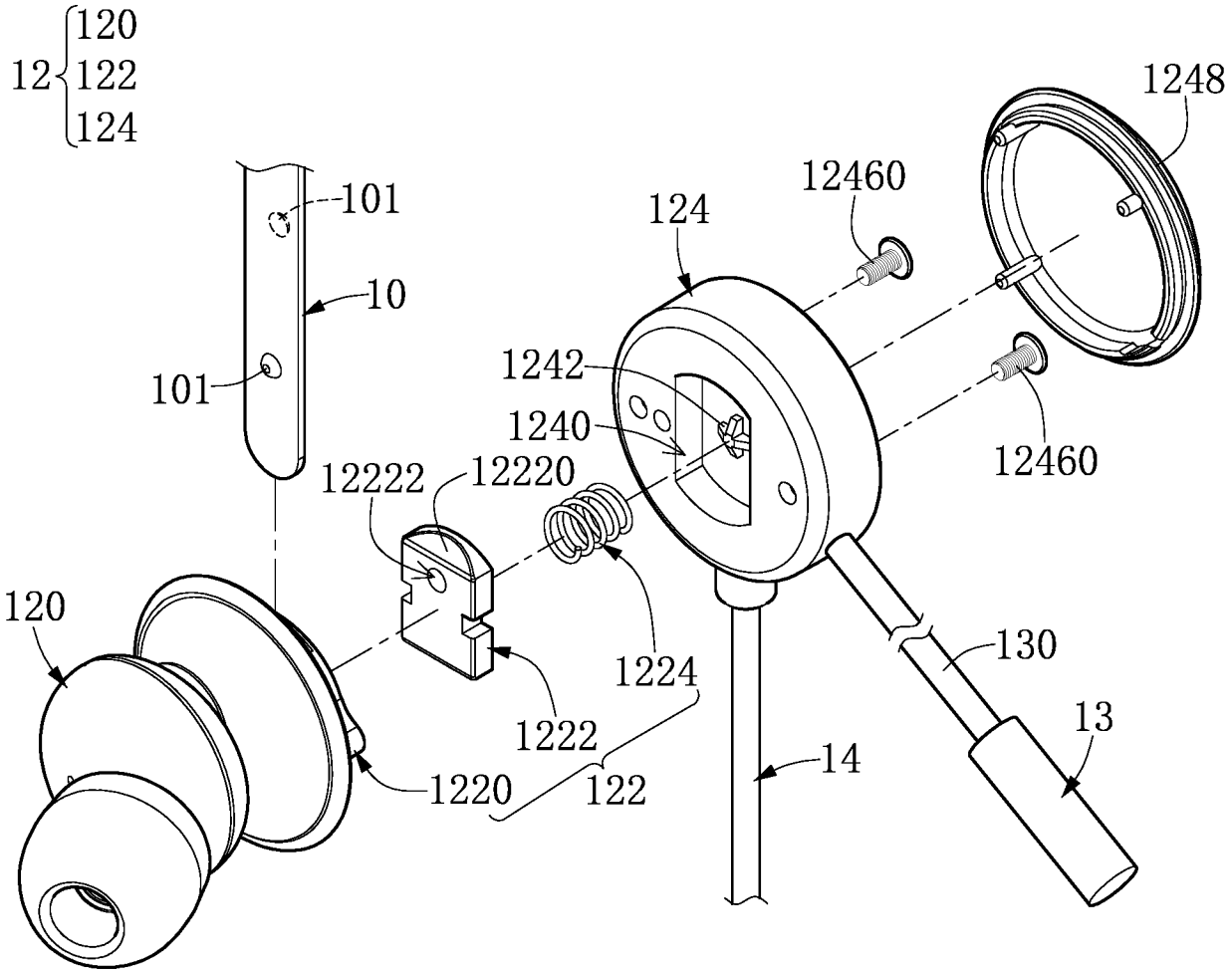
FIG. 4B is an exploded view of the connection part according to one embodiment of the present disclosure from another perspective.

Referring to FIG. 4A and FIG. 4B, FIG. 4A is an exploded view of a connection part according to an embodiment of the present disclosure from one perspective, and FIG. 4B is an exploded view of the connection part according to the embodiment of the present disclosure from another perspective. In the present embodiment, the connection part 122 includes, for example, a fixing slot 1220, a gasket piece 1222, and an elastic member 1224. Specifically, the gasket piece 1222 is disposed between the fixing slot 1220 and the elastic member 1224. One end of the gasket piece 1222 is connected to the elastic member 1224. Depending on an elastic restoring force of the elastic member 1224, another end of the gasket piece 1222 allows the gasket piece 1222 to move toward the fixing slot 1220 and to be in contact with the fixing slot 1220. Therefore, in the present embodiment, the gasket piece 1222 can abut a side of the fixing slot 1220, or abut a side of the headset accessory 10 when the headset accessory 10 is inserted into the through hole 12202.

Further, one end of the elastic member 1224 is fixed at a side of the base body 124. As such, when a surface of the gasket piece 1222 adjacent to the fixing slot 1220 receives pressure from an external force, the gasket piece 1222 moves toward the elastic member 1224 due to the external force. That is to say, depending on whether or not there is pressure from an external force, the gasket piece 1222 which is located in-between the fixing slot 1220 and the base body 124 moves toward the elastic member 1224 or toward the fixing slot 1220.

In one embodiment, apart from two sides of the fixing slot 1220 each having the corresponding through hole 12202, a side that is adjacent to the through holes 12202 has an opening 12204, and the fixing slot 1220 has an accommodating space 12206 formed inside thereof. The accommodating space 12206 is in spatial communication with the through holes 12202 and the opening 12204. The through holes 12202 are provided for insertion of the headset accessory 10, and the opening 12204 is provided for insertion of the gasket piece 1222.

Specifically, when the headset accessory 10 is not inserted into the through holes 12202 at the two sides of the fixing slot 1220, since the headset accessory 10 is not in the accommodating space 12206, the gasket piece 1222 moves toward the accommodating space 12206 due to the elastic restoring force of the elastic member 1224, and abuts against a side of the fixing slot 1220.

However, when the headset accessory 10 is inserted into the through holes 12202 at the two sides of the fixing slot 1220, since the headset accessory 10 is in the accommodating space 12206, the gasket piece 1222 abuts a side of the headset accessory 10 in a direction toward the opening 12204. At this time, the gasket piece 1222 being pressed by the headset accessory 10 then moves from the accommodating space 12206 toward the elastic member 1224.

In one embodiment, a first side of the gasket piece 1222 adjacent to the fixing slot 1220 is configured to have a recess 12222 and a guiding inclined surface 12220. The recess 12222 is provided for engaging with the headset accessory 10. Since the bumps 101 are arranged on the headset accessory 10 along a vertical direction, the headset accessory 10 can be engaged with the recess 12222 of the gasket piece 1222 via the bumps 101. Through adjusting where the different bumps 101 of the headset accessory 10 are engaged with the recess 12222, the headset accessory 10 is capable of being worn by users with different head sizes.

The guiding inclined surface 12220 of the gasket piece 1222 allows the headset accessory 10 to be conveniently inserted into one through hole 12202. Specifically, when the gasket piece 1222 is in the accommodating space 12206, the guiding inclined surface 12220 is adjacent to the through hole 12202. Therefore, when the headset accessory 10 is inserted into the through hole 12202, the headset accessory 10 is in contact with the guiding inclined surface 12220. Further, the guiding inclined surface 12220 receives a force from the headset accessory 10 inserting into the through hole 12202, and the gasket piece 1222 is pressed by such a pushing force and then moves toward the elastic member 1224. Subsequently, the headset accessory 10 can be inserted into the accommodating space 12206 and another through hole 12202 of the fixing slot 1220 until one of the bumps 101 of the headset accessory 10 is smoothly engaged with the recess 12222 of the gasket piece 1222.

More specifically, when the headset accessory 10 is inserted into the through hole 12202, the guiding inclined surface 12220 is configured so that the gasket piece 1222 moves toward the fixing slot 1220 to have the headset accessory 10 abut a side of the fixing slot 1220 due to the elastic restoring force of the elastic member 1224 received by another end of the gasket piece 1222.

In addition, a second side of the gasket piece 1222 adjacent to the base body 124 is configured to have a slot 12224. The slot 12224 of the gasket piece 1222 is not in spatial communication with the recess 12222. For example, the slot 12224 is provided for an end of the elastic member 1224 to be engaged therein, such that the gasket piece 1222 is connected to the elastic member 1224 through the slot 12224. Therefore, when the gasket piece 1222 moves toward the elastic member 1224 by the above-mentioned pushing force from the headset accessory 10, the elastic member 1224 is compressed and deformed in a direction toward the base body 124 according to the strength of the pushing force.

In one embodiment, the base body 124 further includes a buffer slot 1240, and the buffer slot 1240 is recessed in the base body 124. The buffer slot 1240 further includes a fixing member 1242, and an end of the elastic member 1224 is engaged in the fixing member 1242. In other words, an end of the elastic member 1224 adjacent to the base body 124 is a fixing end, and an end of the elastic member 1224 adjacent to the gasket piece 1222 is a free end. The elastic member 1224 can be, for example, a spring. However, the present disclosure is not limited thereto.

For example, when the headset accessory 10 is inserted into the through hole 12202, the headset accessory 10 abuts the gasket piece 1222 and generates a pushing force. Then, the gasket piece 1222 exerts a force on the free end of the elastic member 1224, such that the elastic member 1224 is compressed toward the buffer slot 1240. Therefore, the elastic member 1224 is in a compressed state, and the gasket piece 1222 and the elastic member 1224 are moved to the buffer slot 1240. At this time, the accommodating space 1206 of the fixing slot 1220 accommodates the headset accessory 10.

In contrast, when the headset accessory 10 is not inserted into the through hole 12202, the headset accessory 10 does not generate a pushing force toward the gasket piece 1222. At this time, an elastic restoring force of the free end of the elastic member 1224 pushes the gasket piece 1222 toward the fixing slot 1220. Therefore, the elastic member 1224 is not in the compressed state, and the gasket piece 1222 is moved to the accommodating space 12206 of the fixing slot 1220.

In one embodiment, the base body 124 is configured to further have a first fixing portion 1246 at a side opposite to the buffer slot 1240, and the connection part 122 is configured to have a second fixing portion 12208. The base body 124 is fixedly connected to the second fixing portion 12208 of the connection part 122 through the first fixing portion 1246.

For example, the first fixing portion 1246 can include a plurality of apertures 12462 in the base body 124 and a plurality of screw members 12460. The second fixing portion 12208 can include a plurality of locking grooves arranged in the fixing slot 1220, and an inner wall of each of the locking grooves has a threaded pattern. Therefore, the screw members 12460 can pass through the apertures 12462 and be threadedly engaged with the locking grooves. In this way, the first fixing portion 1246 is fixed to the second fixing portion 12208, such that the base body 124 is connected to the connection part 122.

In other embodiments, the first fixing portion 1246 and the second fixing portion 12208 are not limited to the configurations described above. For example, the first fixing portion 1246 and the second fixing portion 12208 can also be fasteners that are fastened to each other, and the present disclosure is not limited thereto.

Moreover, a cover plate 1248 is disposed at another side of the base body 124. The cover plate 1248 covers the base body 124, so as to seal a hollowed space at the side of the base body 124.

The structure of a connection part inside the second earphone unit 16 is the same as the connection part 122 of the first earphone unit 12, which will not be reiterated herein.

[Embodiment of Stereo Sound In-Ear Earphone Device]

Figure 5:
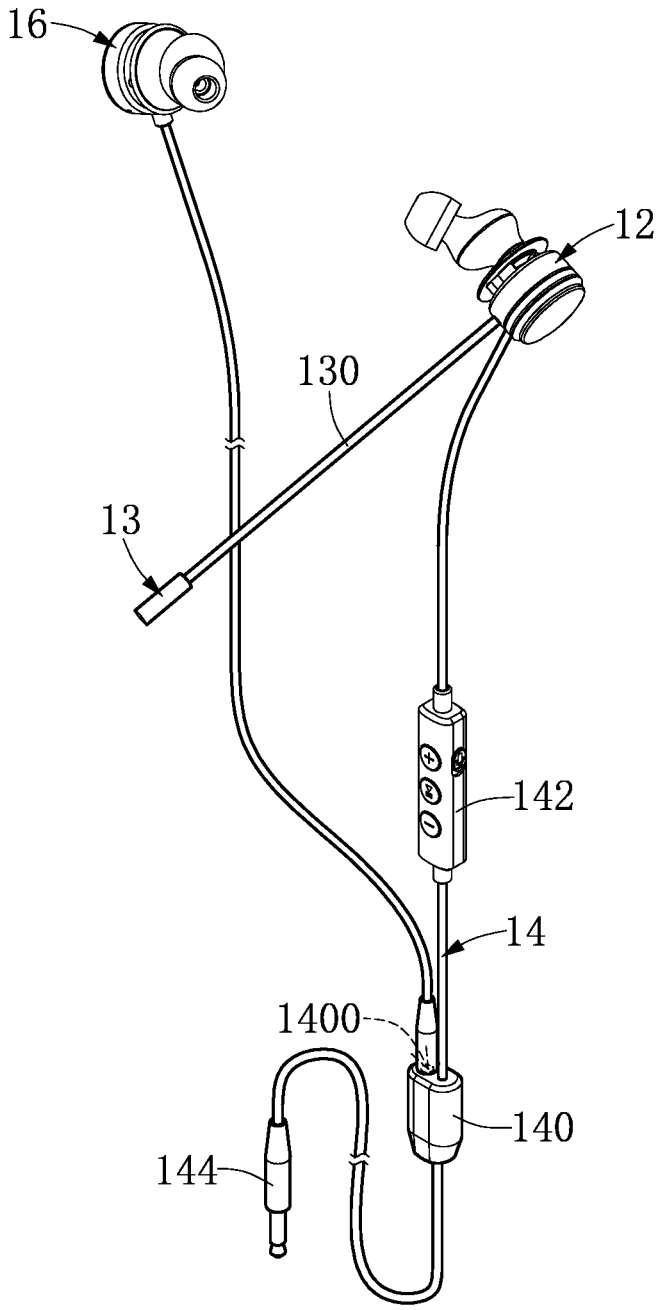
FIG. 5 is a schematic view of a stereo sound in-ear earphone device according to one embodiment of the present disclosure.

Reference is made to FIG. 5, which is a schematic view of a stereo sound in-ear earphone device according to an embodiment of the present disclosure. Compared to FIG. 2, the earphone device illustrated in FIG. 5 does not include the headset accessory 10. In FIG. 5, elements the same as those in FIG. 2 are indicated by the same reference numerals, and can be known from the related descriptions above, which will not be reiterated herein.

The earphone device as shown in FIG. 5 is configured to be worn in the ear. Further, in addition to the first earphone unit 12 fixed thereon, the earphone device can be externally connected to the second earphone unit 16 through the jack 1400 of the splitter 140. As such, the earphone device as shown in FIG. 5 can provide a stereo audio output, which is convenient for the user to have a better listening effect.

[Embodiment of Monaural In-Ear Earphone Device]

Figure 6:
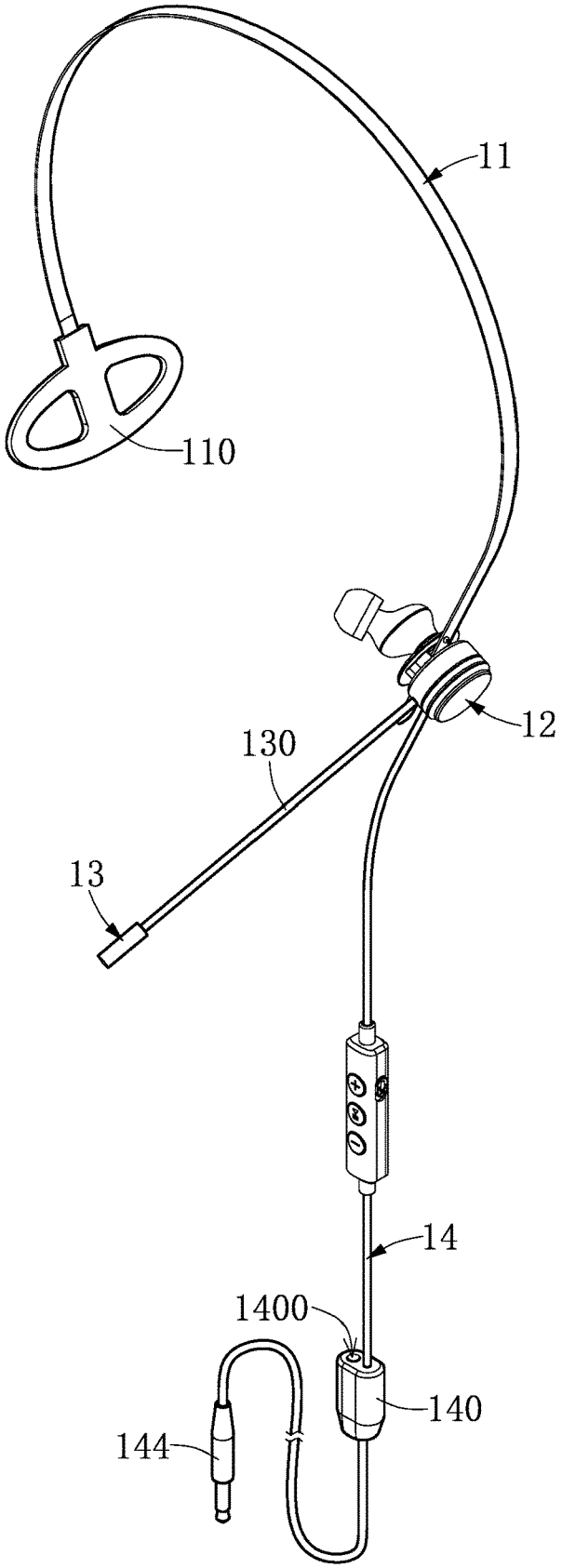
FIG. 6 is a schematic view of a monaural in-ear earphone device according to one embodiment of the present disclosure.

Reference is made to FIG. 6, which is a schematic view of a monaural in-ear earphone device according to an embodiment of the present disclosure. Compared to FIG. 1, the earphone device illustrated in FIG. 6 does not include the second earphone unit 16. In FIG. 6, elements the same as those in FIG. 1 are indicated by the same reference numerals, and can be known from the related descriptions above, which will not be reiterated herein.

The earphone device as shown in FIG. 6 is connected to a headset accessory 11. The headset accessory 11 is configured to have a semi-circular shape, and a midpoint of the headset accessory 11 when the headset accessory 11 is worn on a head is spaced apart from each of two ends thereof by a different length. One end of the headset accessory 11 further includes a fitting part 110, and the fitting part 110 increases a contact area of the headset accessory 11 and the head when the headset accessory 11 is worn on the head, such that the headset accessory 11 can be worn on the head in a more comfortable manner.

Moreover, in the earphone device as shown in FIG. 6, the splitter 140 does not have the second earphone unit 16 additionally plugged therein. Through the first earphone unit 12 being connected to the headset accessory 11, the earphone device can provide a mono audio output, which is convenient for customer service representatives or operators to wear.

[Embodiment of Audio Playing Device]

Figure 7:
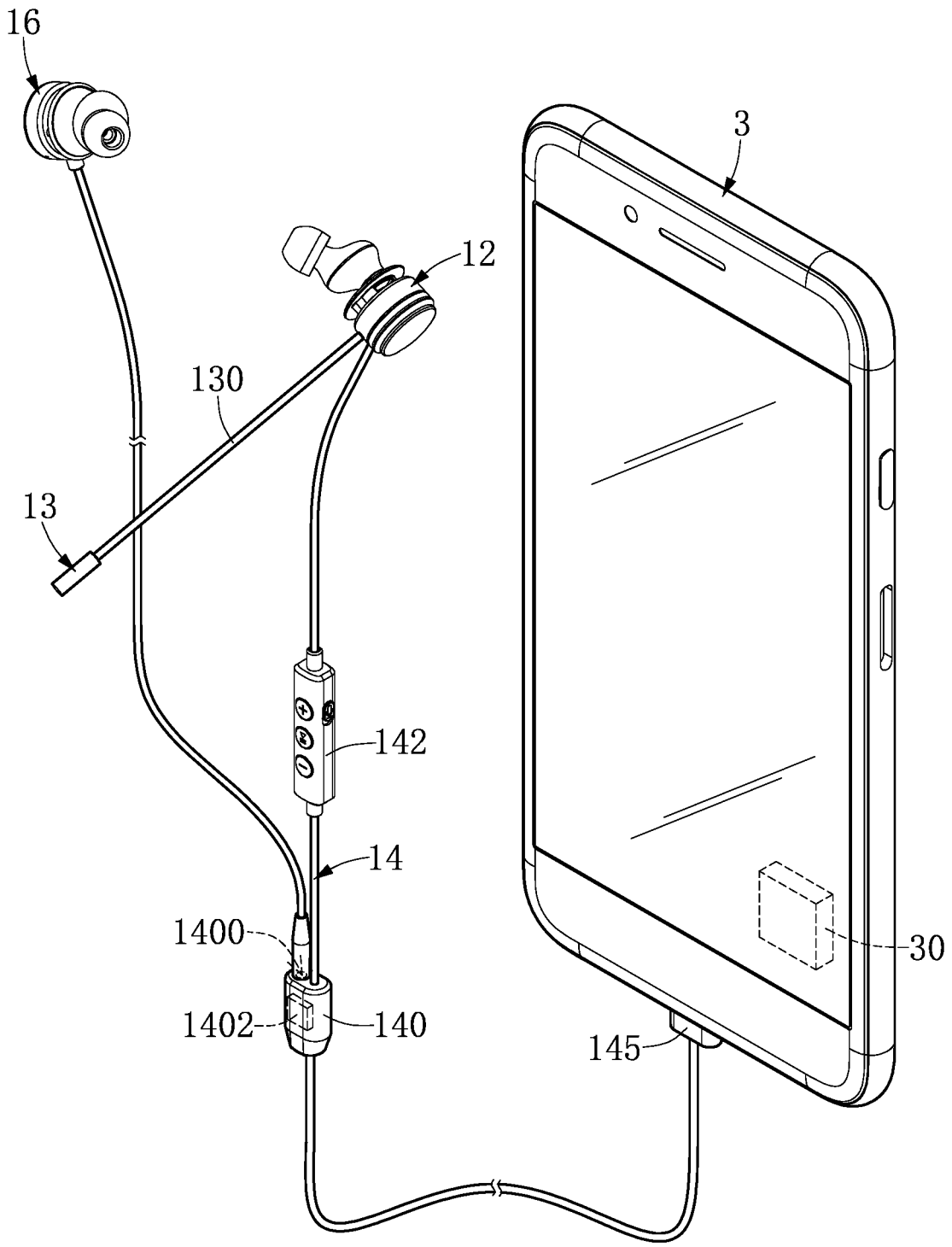
FIG. 7 is a schematic view of an audio playing device providing a stereo audio output according to one embodiment of the present disclosure.
Figure 8:
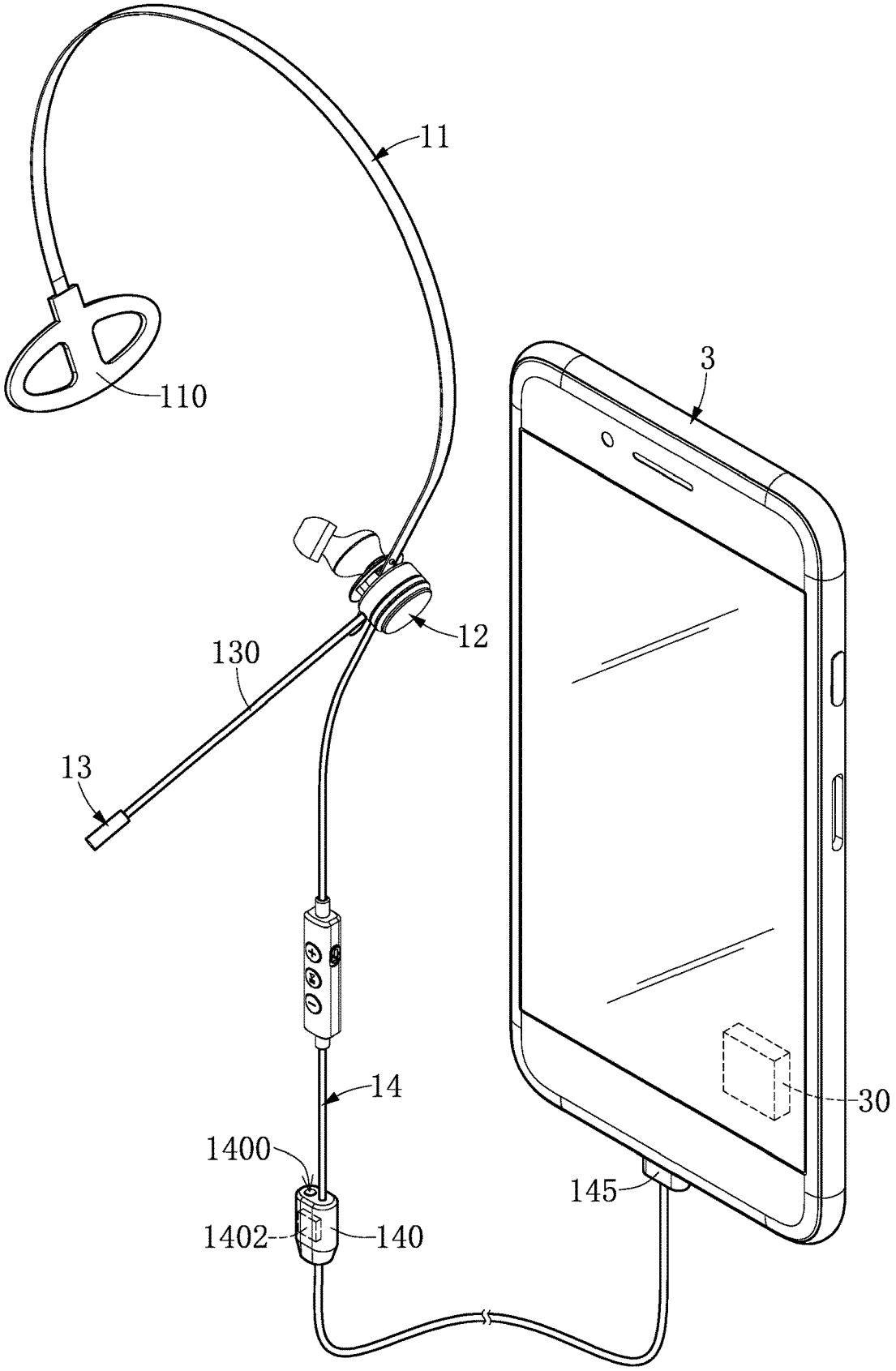
FIG. 8 is a schematic view of the audio playing device providing a mono audio output according to one embodiment of the present disclosure.

Referring to FIG. 7 and FIG. 8, FIG. 7 is a schematic view of an audio playing device providing a stereo audio output according to an embodiment of the present disclosure, and FIG. 8 is a schematic view of the audio playing device providing a mono audio output according to the embodiment of the present disclosure.

An audio playing device 3 as shown in FIG. 7 is connected to the earphone device. For example, the earphone device is plugged into an earphone port of the audio playing device 3 through an earphone plug. The earphone device herein is exemplified by the structure shown in FIG. 5. The splitter 140 of the earphone device is externally connected to the second earphone unit 16 via the jack 1400. Therefore, the earphone device at this time can play stereo sound with the audio playing device 3 outputting stereo sound to the first earphone unit 12 and the second earphone unit 16 of the earphone device.

It should be noted that the splitter 140 in the earphone device further includes a detection part 1402. The detection part 1402 is mainly used to detect whether or not the jack 1400 has the second earphone unit 16 plugged therein.

For example, when the detection part 1402 detects that the jack 1400 is externally connected to the second earphone unit 16, the detection part 1402 outputs a first detection signal to the audio playing device 3 through an earphone plug 145. When the detection part 1402 detects that the jack 1400 does not have the second earphone unit 16 plugged therein, the detection part 1402 outputs a second detection signal to the audio playing device 3 through the earphone plug 145.

Specifically, the detection part 1402 recognizes insertion or non-insertion of the second earphone unit 16 through detection of a change in pin level in the jack 1400. When the pin level in the jack 1400 is at a first level, the jack 1400 has the second earphone unit 16 plugged therein. When the pin level in the jack 1400 is at a second level, the jack 1400 does not have the second earphone unit 16 plugged therein.

In another embodiment, a micro-touch switch can be disposed in the jack 1400. When the jack 1400 has the second earphone unit 16 plugged therein, the detection part 1402 outputs the first detection signal upon detecting that the micro-touch switch in the jack 1400 is touched by the second earphone unit 16. When the jack 1400 does not have the second earphone unit 16 plugged therein, the detection part 1402 outputs the second detection signal upon detecting that the micro-touch switch in the jack 1400 is not touched by the second earphone unit 16.

Therefore, in FIG. 7, the earphone device outputs the first detection signal to the audio playing device 3 through the detection part 1402, and a processing circuit 30 of the audio playing device 3 controls the audio playing device 3 to play sound in a stereo mode according to the first detection signal. For example, the processing circuit 30 can play an audio source, output sound from a first channel of the audio source through the first earphone unit 12, and output sound from a second channel of the audio source through the second earphone unit 16. In this way, the earphone device is capable of providing a stereo sound effect.

In FIG. 8, the earphone device outputs the second detection signal to the audio playing device 3 through the detection part 1402, and the processing circuit 30 of the audio playing device 3 controls the audio playing device 3 to play sound in a mono mode according to the second detection signal. The earphone device in FIG. 8 is exemplified by the structure shown in FIG. 6. At this time, the processing circuit 30 can play an audio source, and output sound from the first channel of the audio source through the first earphone unit 12. In this way, the earphone device is capable of providing a mono sound effect.

Transmission between the audio playing device 3 and each of the earphone devices in FIG. 7 and FIG. 8 as mentioned above is conducted through a transmission technology that meets the universal serial bus (USB) standard. That is to say, the earphone plug 145 of the earphone devices in FIG. 7 and FIG. 8 is a USB earphone plug, but the present disclosure is not limited thereto. Moreover, the above-mentioned earphone device in FIG. 7 can be replaced by the headphone device as shown in FIG. 2. The processing circuit 30 as shown in FIG. 7 and FIG. 8 can be one of application-specific integrated circuit (ASIC), field-programmable gate array (FPGA) and system on a chip (SoC), or any combination thereof. However, the present disclosure is not limited thereto. The audio playing device 3 can be, for example, a mobile communication device, a computer device, audio electronics, a television, a game console, or a personal stereo.

Beneficial Effects of the Embodiments

In conclusion, the earphone device provided by the present disclosure can be optionally used with the headset accessory. When the earphone device is used with the headset accessory, the earphone device becomes the headphone device. Further, in addition to the first earphone unit fixed thereon, the earphone device can be externally connected to the second earphone unit. That is, the earphone device can provide a mono audio output or a stereo audio output, which is decided by whether the earphone device is externally connected to the second earphone unit by the user. Therefore, through a unique structural design, the earphone device of the present disclosure can satisfy various wearing requirements made by different users. In addition, the users can decide whether a mono sound effect or a stereo sound effect is to be provided.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An earphone device configured to be used with a headset accessory, comprising:

a first earphone unit, wherein the first earphone unit includes a base body, a speaker, and a connection part, the speaker is fixed at a side of the base body, the connection part is formed between the base body and the speaker, and the connection part has a through hole; and a cable including a splitter, wherein the splitter is electrically connected to each of an earphone plug and the first earphone unit, and the splitter has a jack;

wherein the through hole of the first earphone unit is provided for insertion of the headset accessory, such that the headset accessory is detachably connected to the first earphone unit;

wherein the connection part includes:

a fixing slot, wherein the fixing slot has the through hole, and a side of the through hole has an opening;

a gasket piece; and an elastic member, two ends thereof being connected to the gasket piece and a buffer slot of the base body, respectively;

wherein, when the headset accessory is not inserted into the through hole, the gasket piece moves toward the fixing slot through the opening by an elastic restoring force of the elastic member;

wherein, when the headset accessory is inserted into the through hole, the gasket piece abuts the headset accessory in the fixing slot, and the gasket piece moves toward the buffer slot by a pushing force from the headset accessory inserting into the through hole.

2. The earphone device according to claim 1, wherein the splitter splits and outputs an audio signal inputted from the earphone plug to the first earphone unit and the jack.

3. The earphone device according to claim 2, further comprising a second earphone unit, wherein the second earphone unit is plugged into the jack, and the second earphone unit has a through hole provided for insertion of the headset accessory, such that the headset accessory is detachably connected to the second earphone unit.

4. The earphone device according to claim 3, wherein the second earphone unit includes a base body, a speaker, and a connection part; wherein the speaker of the second earphone is fixed at a side of the base body of the second earphone, the connection part of the second earphone is formed between the base body of the second earphone and the speaker of the second earphone, and the connection part of the second earphone has the through hole.

5. The earphone device according to claim 3, wherein the splitter farther includes a detection part; wherein, when the detection part detects that the jack has the second earphone unit plugged therein, the detection part outputs a first detection signal through the earphone plug; wherein, when the detection part detects that the jack does not have the second earphone unit plugged therein, the detection part outputs a second detection signal through the earphone plug.

6. The earphone device according to claim 2, wherein the cable further includes an adjustment part and a microphone, the adjustment part is provided for controlling audio playing of the earphone device, and the microphone is disposed in the adjustment part or is connected to the first earphone unit via a connecting rod.

7. The earphone device according to claim 1, wherein a side of the gasket piece adjacent to the fixing slot is configured to have a guiding inclined surface and a recess; wherein the guiding inclined surface is disposed corresponding to the through hole, such that the headset accessory is inserted into the through hole via the guiding inclined surface; wherein the recess allows a bump of the headset accessory to be positioned thereon.

8. The earphone device according to claim 7, wherein the base body is configured to have a first fixing portion, and the connection part is configured to have a second fixing portion; wherein the base body is fixed to the second fixing portion of the connection part through the first fixing portion.

9. An audio playing device configured to include an earphone port that has the earphone device as claimed in claim 1 plugged therein, wherein the splitter in the earphone device includes a detection part; wherein, when the detection part detects that the jack has a second earphone unit plugged therein, the detection part outputs a first detection signal to a processing circuit of the audio playing device, and the processing circuit controls the audio playing device to play sound in a stereo mode according to the first detection signal; wherein, when the detection part does not detect that the jack has the second earphone unit plugged therein, the detection part outputs a second detection signal to the processing circuit of the audio playing device, and the processing circuit controls the audio playing device to play sound in a mono mode according to the second detection signal.

10. A headphone device, comprising:

a headset accessory;

a first earphone unit, wherein the first earphone unit includes a base body a speaker, and a connection part the speaker is fixed at a side of the base body, the connection part is formed between the base body and the speaker and the connection part has a through hole; and a cable including a splitter, wherein the splitter is electrically connected to each of an earphone plug and the first earphone unit, and the splitter has a jack;

wherein the through hole of the first earphone unit is provided for insertion of the headset accessory, such that the headset accessory is detachably connected to the first earphone unit;

wherein the connection part includes:

a fixing slot, wherein the fixing slot has the through hole, and a side of the through hole has an opening;

a gasket piece; and an elastic member, two ends thereof being connected to the gasket piece and a buffer slot of the base body, respectively;

wherein, when the headset accessory is not inserted into the through hole, the gasket piece moves toward the fixing slot through the opening by an elastic restoring force of the elastic member;

wherein, when the headset accessory is inserted into the through hole, the gasket piece abuts the headset accessory in the fixing slot, and the gasket piece moves toward the buffer slot by a pushing force from the headset accessory inserting into the through hole.

11. The headphone device according to claim 10, wherein the headset accessory is configured to have a semi-circular shape, and a midpoint of the headset accessory when the headset accessory is worn on a head is spaced apart from each of two ends thereof by a same length.

12. The headphone device according to claim 10, wherein the headset accessory is configured to have a semi-circular shape, and a midpoint of the headset accessory when the headset accessory is worn on a head is spaced apart from each of two ends thereof by a different length; wherein one end of the headset accessory further includes a fitting part, and the fitting part increases a contact area of the headset accessory and the head when the headset accessory is worn on the head.

13. The headphone device according to claim 10, wherein the splitter splits and outputs an audio signal inputted from the earphone plug to the first earphone unit and the jack.

14. The headphone device according to claim 13, further comprising a second earphone unit, wherein the second earphone unit is plugged into the jack, and the second earphone unit has a through hole provided for insertion of the headset accessory, such that the headset accessory is detachably connected to the second earphone unit.

15. The headphone device according to claim 14, wherein the second earphone unit includes a base body, a speaker, and a connection part; wherein the speaker of the second earphone is fixed at a side of the base body of the second earphone, the connection part of the second earphone is formed between the base body of the second earphone and the speaker of the second earphone, and the connection part of the second earphone has the through hole.

16. The headphone device according to claim 13, wherein the cable further includes an adjustment part and a microphone, the adjustment part is provided for controlling audio playing of the headphone device, and the microphone is disposed in the adjustment part or is connected to the first earphone unit via a connecting rod.

17. The headphone device according to claim 10, wherein a side of the gasket piece adjacent to the fixing slot is configured to have a guiding inclined surface and a recess; wherein the guiding inclined surface is disposed corresponding to the through hole, such that the headset accessory is inserted into the through hole via the guiding inclined surface; wherein the recess allows a bump of the headset accessory to be positioned thereon.

18. The headphone device according to claim 17, wherein the base body is configured to have a first fixing portion, and the connection part is configured to have a second fixing portion; wherein the base body is fixed to the second fixing portion of the connection part through the first fixing portion.

* * * * *